US009435131B2

(12) United States Patent
Miller, Jr. et al.

(10) Patent No.: US 9,435,131 B2
(45) Date of Patent: Sep. 6, 2016

(54) PORTABLE AND REUSABLE CONNECTION DEVICE HAVING SECURE ANCHOR POINT

(71) Applicant: Dale Corp, Glenside, PA (US)

(72) Inventors: Kenneth Daniel Miller, Jr., Dresher, PA (US); Dale Edsel Lintner, Jr., Meadowbrook, PA (US)

(73) Assignee: Dale Corporation, Glenside, PA (US)

( * ) Notice: Subject to any disclaimer, the term of this patent is extended or adjusted under 35 U.S.C. 154(b) by 20 days.

(21) Appl. No.: 13/752,349

(22) Filed: Jan. 28, 2013

(65) Prior Publication Data

US 2013/0193286 A1 Aug. 1, 2013

Related U.S. Application Data

(60) Provisional application No. 61/591,137, filed on Jan. 26, 2012.

(51) Int. Cl.
*E04G 21/32* (2006.01)
*A62B 35/00* (2006.01)

(52) U.S. Cl.
CPC ..... *E04G 21/3233* (2013.01); *A62B 35/00* (2013.01); *A62B 35/0068* (2013.01); *E04G 21/3242* (2013.01)

(58) Field of Classification Search
CPC ..... E04H 12/22; E04H 17/08; E04G 5/001; E04G 21/32; E04G 21/3204; E04G 21/3223; E04G 21/3233; E04G 21/3238; E04G 21/3242; E04G 21/3261; F16M 13/02; A62B 35/00; A62B 35/0068
USPC ..... 182/82, 113, 45; 248/558, 518, 534, 248/536, 237, 236, 228.1, 228.5; 52/713, 52/704, DIG. 12; 256/65.02–65.07
See application file for complete search history.

(56) References Cited

U.S. PATENT DOCUMENTS 1,039,554 A * 9/1912 Lindhorst ..... A01K 97/10 248/231.41
3,480,257 A * 11/1969 Bourn ..... E04G 21/3233 182/113
3,595,510 A * 7/1971 Hutchinson ..... E04G 5/06 182/113
3,995,833 A * 12/1976 McLaughlin ..... E04G 21/3233 248/231.41

(Continued)

FOREIGN PATENT DOCUMENTS

ES EP 1683930 A2 * 7/2006 ..... E04G 11/36

*Primary Examiner* — Jonathan Liu
*Assistant Examiner* — Guang H Guan
(74) *Attorney, Agent, or Firm* — Douglas J. Ryder; Ryder, Lu, Mazzeo & Konieczny LLC

(57) ABSTRACT

A mounting bracket to be utilized in a fall protection system. The mounting bracket includes an adjustable securing means to anchor to structural members of varying sizes and an adjustable anchor point to receive and secure a post therein. The adjustable securing means includes a first bracket and a second bracket capable of being secured together in different configurations (based on different heights of the structural member) to anchor the adjustable securing means to the structural member. The adjustable anchor point is to receive the post within a defined distance from the structural member and may include one or more open-ended receiving stanchions. The adjustable anchor point is capable of securing the post in different configurations. The post includes a plurality of brackets capable of holding railings in order to create a guardrail. The posts may include other items and be utilized in other systems.

19 Claims, 11 Drawing Sheets

(56) References Cited

U.S. PATENT DOCUMENTS 4,037,824 A * 7/1977 Whitmer ..... A62B 35/0056 182/113
5,029,670 A * 7/1991 Whitmer ..... 182/113
5,503,358 A * 4/1996 Lapp ..... E04G 5/06 182/82
5,570,559 A * 11/1996 Lewis ..... E04G 21/3214 182/113
5,829,549 A * 11/1998 Flynn ..... 182/82
6,003,630 A * 12/1999 Whalen ..... E04G 3/20 182/150
6,053,280 A * 4/2000 Smith et al. ..... 182/82
6,053,281 A * 4/2000 Murray ..... E04G 21/3223 182/113
6,585,080 B2 * 7/2003 Murray ..... E04G 21/3233 182/113
6,666,298 B2 * 12/2003 Volkman ..... 182/82
6,679,482 B2 * 1/2004 Allenbaugh ..... E04G 21/3233 182/113
6,908,075 B1 * 6/2005 Nichols ..... 256/59
6,945,358 B2 * 9/2005 Albano ..... 182/82
7,048,090 B2 * 5/2006 Dean ..... A62B 35/0068 182/3
7,322,553 B2 * 1/2008 Rexroad ..... E04G 21/3261 182/138
8,196,705 B2 * 6/2012 Jejina ..... 182/150
8,827,037 B2 * 9/2014 Chilton ..... 182/113
2006/0237263 A1 * 10/2006 Gaines ..... 182/113
2013/0193286 A1 * 8/2013 Miller, Jr. ..... A62B 35/00 248/218.4

* cited by examiner

PORTABLE AND REUSABLE CONNECTION DEVICE HAVING SECURE ANCHOR POINT

PRIORITY

This application claims the priority under 35 USC §119 of Provisional Application 61/591,137 entitled "Portable and Re-usable Fall Protection System" filed on Jan. 26, 2012 and having K. Dan Miller as inventor. Application 61/591,137 is herein incorporated by reference in its entirety.

BACKGROUND

The federal Occupational Safety and Health Administration ("OSHA") recently rescinded a directive issued in 1999 that allowed for certain alternative means for employing fall protection on residential construction projects. The result of the rescission was to impose all of the fall protection requirements of Subpart M of 29 CFR 1926 on residential construction projects, making the requirements equal to those imposed on commercial construction projects.

Subpart M of the OSHA regulations stipulate that fall protection must be utilized for the safety of workers on a walking/working surface with an unprotected side or edge and which is six (6) feet or more above a lower level, including the ground. The fall protection can consist of a safety net system, personal fall arrest system or a guardrail system.

A wide variety of guardrail, safety net and fall arrest systems have been created and are available on the market, however virtually all of the existing available systems have critical deficiencies and shortcomings. With respect to guardrail systems, most commercially available systems must be secured to the actual work surface, and therefore must be removed in order to complete tasks on the edge of the work surface or above or below it, placing workers at risk.

In addition, available guardrail systems are anchored via nails, bolts or screws, requiring tools or power equipment to fasten the anchoring mechanism or component in an almost "permanent" attachment method. Such means and methods of attachment or anchoring require a substantial investment of time and material, and require a higher level of knowledge and an enhanced operator skill set, significantly reducing or precluding the transferability or portability of the system and the re-use of many components.

Further, most of the systems described are more complicated than necessary, which results in worker non-compliance in the placement or application of the system due to system ignorance, haste, or lack of proper tools or materials.

In addition to the new onus being placed upon residential builders and contractors, there is a need for a simplified, more efficient, more cost-effective portable fall-protection and guardrail system in the commercial and residential construction and safety industries.

BRIEF DESCRIPTION OF THE DRAWING

The features and advantages of the various embodiments will become apparent from the following detailed description in which.

DETAILED DESCRIPTION

Figure 1A:
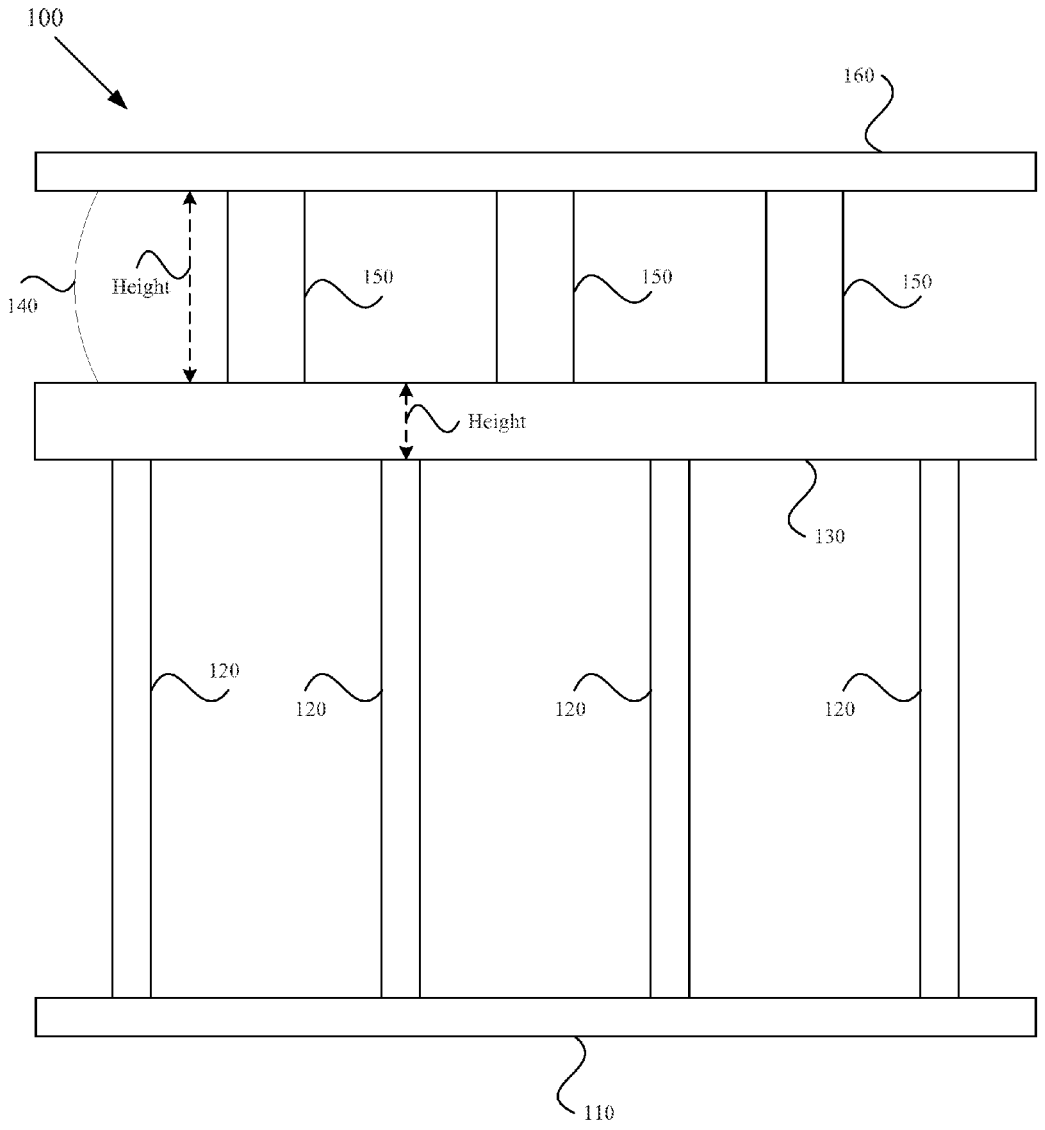
FIGS. 1A-C illustrate several views of an example construction project where another level is to be added and thus requires some type of fall protection system.

FIG. 1A illustrates a front cross section view of an example construction project (e.g., exterior wall, interior wall below an opening in upper level) 100. The construction project 100 includes a lower level framed out and the start of an upper level being formed thereon. The lower level may include flooring 110, framing members 120 (e.g., for a wall), and a structural member (e.g., top plate) 130 to support the framing members 120. The term structural member, as used herein, need not be a load bearing member or part of a load bearing wall. Floor joists (or trusses) 150 may be placed on the structural member 130 and flooring 160 for the next level may be placed on the floor joists 150. A floor cavity 140 is the gap between the walls (framing 120) of one level and the floor 160 of a next level.

Figure 1B:
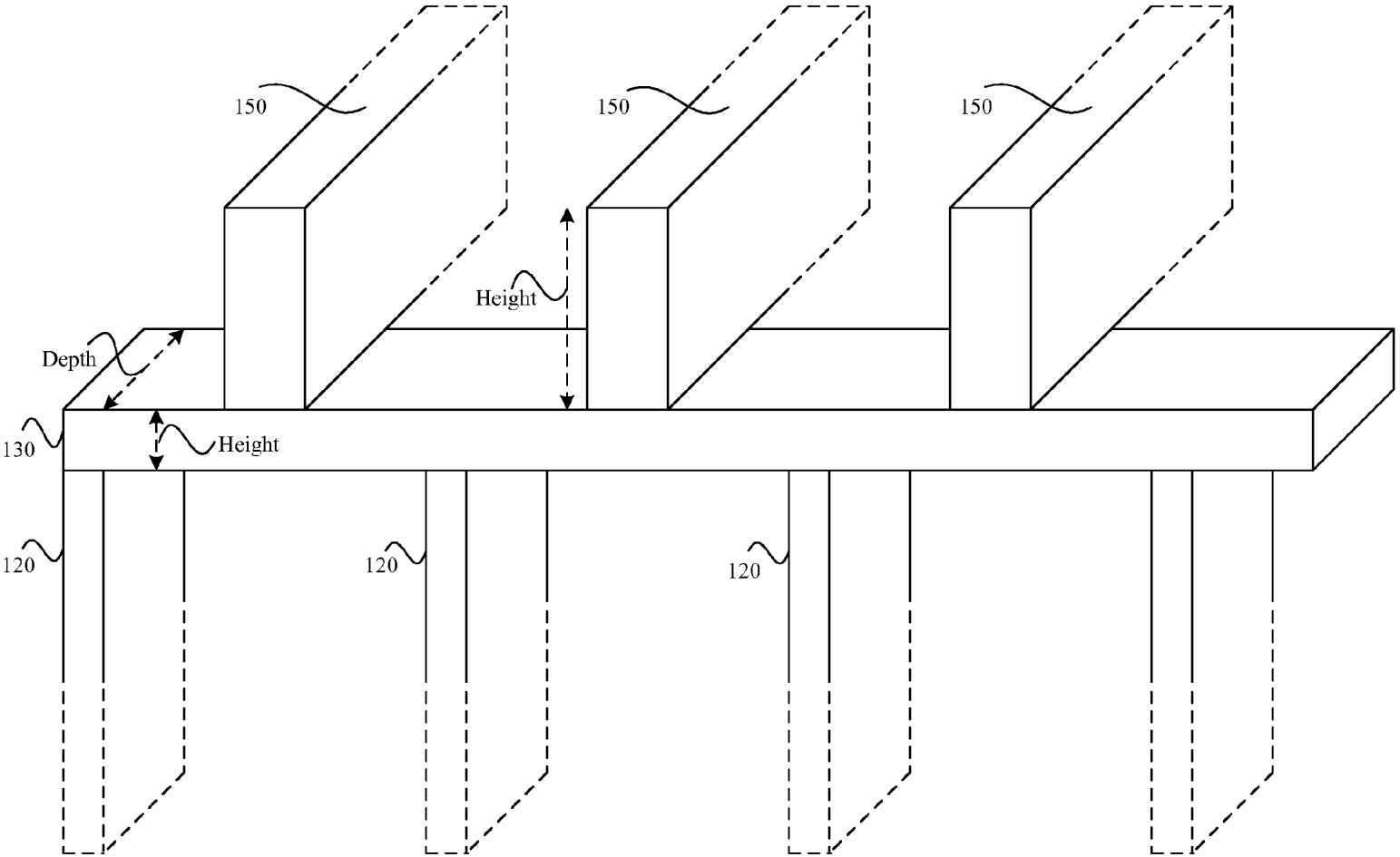
Figure 1C:
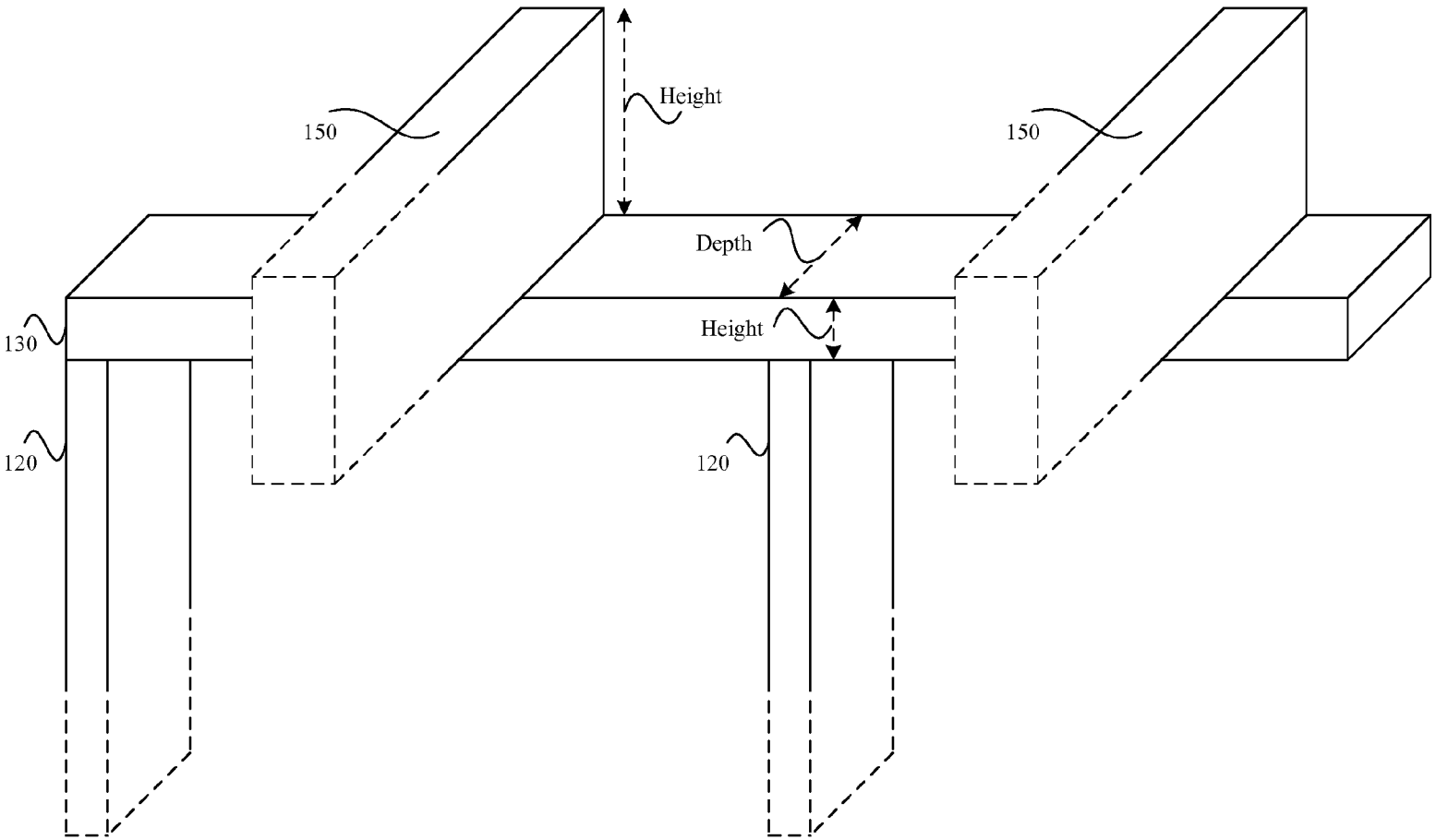

FIG. 1B illustrates a partial front perspective view of the example construction project 100. If the project 100 was an exterior wall the front view would be of an exterior surface of the wall. FIG. 1C illustrates a partial back perspective view of the example construction project 100. If the project 100 was an exterior wall the back view would be of an interior surface of the wall. The partial views of FIGS. 1B-C illustrate the structural member 130 on top of the framing 120 and the floor joists 150 extending from the framing 120 into the project 100 to provide support for the flooring (not illustrated) of the next level. The framing 120 and the floor joists 150 are partially illustrated as dotted lines to represent that they extend further than illustrated.

It should be noted that the height and depth of the structural member 130 illustrated in FIGS. 1A-C may vary based on the project (e.g., weight and force to be supported).

Furthermore, the height of the floor joists 150 and thus the height of the floor cavity 140 may also vary based on the project.

In order to do any work on the next level some type of fall protection system is required. Railing systems are often used along exterior walls or openings in the floor of the interior (e.g., stair cases). Railing systems that are secured in some fashion to the next level (e.g., screwed into the flooring, secured to the joists or other structure of the next level) would require an individual to be on the next level to install the railing system. Accordingly, a separate fall protection system would be required to install the railing system. Furthermore, if the railing system is secured to the next level it may be in the way of the framing for the next level or possibly the flooring.

What is needed is a railing system that may be installed without the need for an individual to be on the next level for installation, does not interfere with work to be performed on the next level, can be installed without the need for special training/certifications and does not require any special tools. The railing system may include a mounting bracket that can be connected to a lower level (e.g., structural member). The mounting bracket may include an anchor point for mounting posts of a railing system or other systems. The anchor point may extend past where, for example, the framing of the upper level is to be installed so as not to get in the way. The anchor point may be such that the posts and rails of the railing system will be within a certain distance from the opening (e.g., exterior wall) as defined in the appropriate regulations.

It should be noted that the mounting bracket may be connected to any point in a project (e.g., building) that is strong enough to hold the bracket and any posts that are part of a railing system or any other system that may be mounted thereto. For ease of description the mounting bracket will be discussed as being connected to a structural member. The structural member is to be interpreted as any strong enough point as defined above and is not limited to load bearing structures.

Figure 2A:
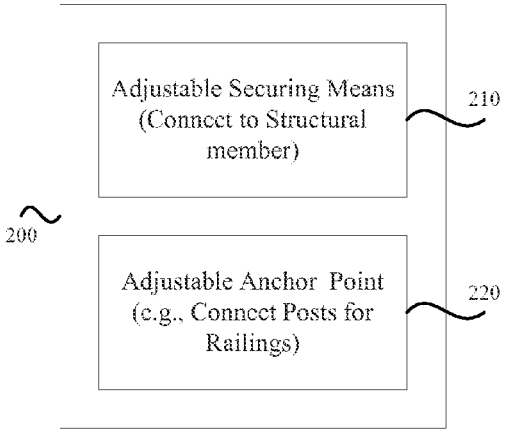
FIG. 2A illustrates a block diagram of an example mounting bracket, according to one embodiment.

FIG. 2A illustrates a block diagram of an example mounting bracket 200. The mounting bracket 200 may include an adjustable securing means 210 and an adjustable anchor point 220. The adjustable securing means 210 may be capable of securing to structural members (or other support means) 130 of varying sizes. The adjustable anchor point 220 may be capable of extending past varying depths of structural members (or other support means) 130 so that posts for guard rail systems may be installed.

Figure 2B:
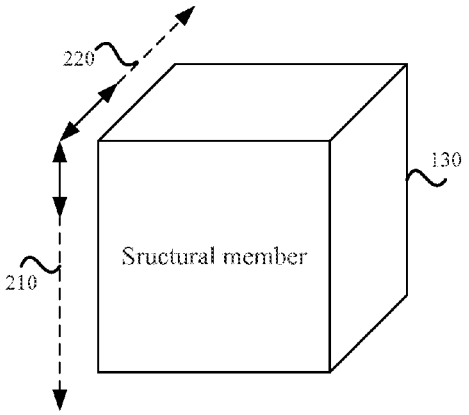
FIG. 2B illustrates the adjustable nature of an example mounting bracket, according to one embodiment.

FIG. 2B illustrates the adjustable nature of an example mounting bracket (e.g., 200 of FIG. 2A). As noted above, the height of the structural member 130 may vary based on the project. For example, some projects utilize two top plates (e.g., two by fours) for the structural member 130 while others may use three. Accordingly, the adjustable securing means 210 should be able to account for these different heights. Furthermore the depth of the structural member 130 may vary based on the project. For example, a bearing wall may utilize 2×4s or 2×6s in the framing thereof. Accordingly, the adjustable anchor point 220 should be able to account for these different depths.

Figure 3A:
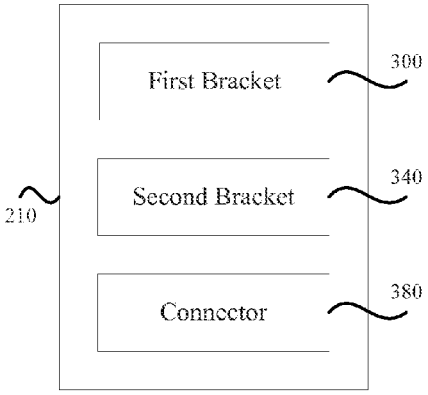
FIG. 3A illustrates a block diagram of an example adjustable securing means utilized in an example mounting bracket, according to one embodiment.

FIG. 3A illustrates a block diagram of an example adjustable securing means 210. The adjustable securing means 210 may include a first bracket 300, a second bracket 340, and a connection means 380. The first bracket 300 and the second bracket 340 may be configured in a fashion that enables the distance between them in a secured configuration to vary based on the height of the structural member 130. The connection means 380 may be utilized to secure the first bracket 300 and the second bracket 340 together in the appropriate configuration.

Figure 3B:
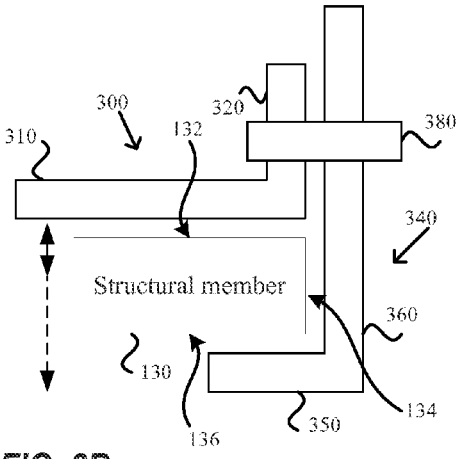
FIG. 3B illustrates an example configuration of an adjustable securing means, according to one embodiment.

FIG. 3B illustrates an example configuration of an adjustable securing means (e.g., 210 of FIG. 3A). The first bracket 300 (illustrated on top of the structural member) and the second bracket 340 (illustrated on bottem/side of the structural member) may both be L-shaped brackets. A first leg 310 of the first bracket 300 may rest on a first surface 132 (e.g., top) of the structural member 130 and a second leg 320 may extend away from (e.g., upward) the structural member 130 in alignment with a first side (e.g., inner surface 134 thereof. A first leg 350 of the second bracket 340 may be in contact with a second surface 136 (e.g., bottom) of the structural member 130 and a second leg 360 may extend towards (e.g., upward) the structural member 130 with a portion of it resting on the first side 134 thereof. The connection means 380 is utilized to secure the second leg 320 (of the first bracket 300) and the second leg 360 (of the second bracket 340) together. The first bracket 300 and the second bracket 340 may be secured together in different alignments (e.g., varying distances between the first leg 310 and the first leg 350). The different alignments of the first bracket 300 and the second bracket 340 enable the adjustable securing means to be utilized with structural members 130 of varying heights.

The first bracket 300 and the second bracket 340 may be made of galvanized light gauge steel, aluminum or other formed metal(s), plastics, carbon fiber, composite materials, other materials providing sufficient strength and durability, or some combination thereof.

Figure 4A:
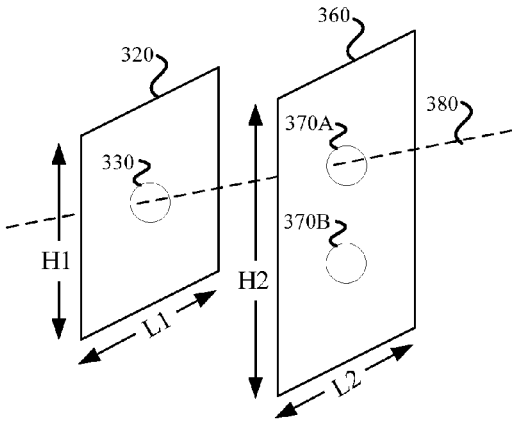
FIG. 4A-B illustrate examples of how the first bracket and the second bracket may be secured to each other in different alignments, according to one embodiment.

FIG. 4A illustrates an example of how the first bracket 300 and the second bracket 340 may be secured to each other in different alignments. For ease of illustration only the second legs 320, 360 (e.g., upward extending portions) of the first bracket 300 and the second bracket 340 are illustrated. The second legs 320, 360 may have the same length (L1=L2). The height of the leg 360 may be greater than the height of the leg 320 as it needs to traverse the height of structural members 130 (H2>H1). The leg 320 may include one or more holes 330 formed therein (one illustrated) and the leg 360 may include one or more holes 370 formed therein (two illustrated 370A, 370B). The holes 330, 370 may be capable of being aligned with one another (e.g., holes may be same distance from sides). The alignment of one of the holes 370A, 370B with the hole 330 may determine the configuration of the adjustable securing means (distance between the leg 310 and the leg 350) which is based on height of the structural member 130. When the appropriate holes are aligned a connection means 380 may be placed therethrough. The connection means 380 may be, for example, a bolt, a rod, a screw or other device that can be placed through the holes and secure the legs 320, 360 together in order to anchor the adjustable securing means to the structural member 130. The connection means 380 may also include a nut or the like that can be utilized with a bolt, screw or rod to provide additional security.

As illustrated in FIG. 4A, the adjustable securing means can be arranged in one of two configurations to secure to two different size structural members (e.g., two top plates, three top plates). The adjustable securing means is in no way limited thereto. Rather, any number of holes 330, 370 can be utilized to provide varying configurations. For example, providing a plurality of holes on each leg 320, 360 where the holes on the leg 320 are spaced differently than the holes on the leg 360 may provide a broader range of configurations. If one leg had three holes and one leg had two holes there would be a total of six different configurations (each of the two holes could be aligned with each of the three holes, 2×3 configurations).

FIG. 4A illustrated a single column of holes on each leg but is in no way intended to be limited thereto. Rather, any number of columns of holes that are alignable could be utilized without departing from the current scope. For example, rather than utilizing holes that are centered as illustrated two columns of holes could be utilized where each column was closer to one edge than the other.

Figure 4B:
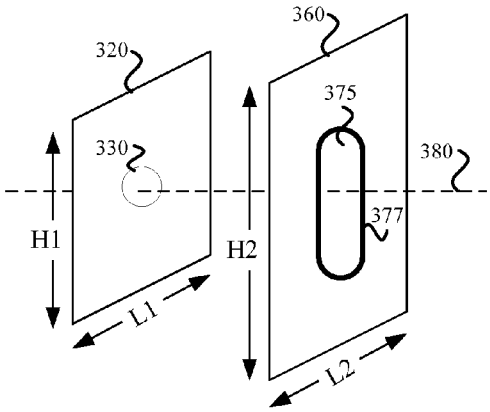

FIG. 4B illustrates an example of how the first bracket 300 and the second bracket 340 may be secured to each other in different alignments. For ease of illustration only the second legs 320, 360 are illustrated. The second leg 320 may include one or more holes 330 formed therein (one illustrated) and the second leg 360 may include one or more slots 375 formed therein (one illustrated). The hole 330 and the slot 375 may be capable of being aligned with one another (e.g., may be same distance from sides). The use of the slot 375 enables a continuum of configurations to be selected. At the appropriate location (configuration) the connection means 380 may be utilized to secure the legs 320, 360 together (pass through the slot 375 and the hole 330). The connection means 380 may include, for example, a bolt and a nut to ensure location within the slot 375 is maintained and to secure the legs 320, 360 together. The slot 375 may include a seal 377 to aid in securing the connection means 380 at appropriate location therewithin.

FIG. 4B illustrated a single column of holes 330 and a single slot 375 but is in no way is intended to be limited thereto. Rather, any number of columns of holes 330 and slots 375 that are alignable could be utilized without departing from the current scope. For example, rather than utilizing holes 330 and slots 375 that are centered as illustrated two columns of holes 330 and slots 375 could be utilized where each column was closer to one edge than the other. FIG. 4B illustrated the holes 330 on the leg 320 and the slot 375 on the leg 360 but is in no way is intended to be limited thereto. Rather, the leg 320 could include slots and the leg 360 could include holes, or some combination of holes and slots could be utilized on each without departing from the current scope.

According to one embodiment, rather than both the legs 320, 360 having holes and/or slots one of the legs may include posts that can pass through appropriate holes or slots in the other leg. The leg not having the posts may include one or more slots that may include one or more grooves extending from one or both sides. The posts may slide within the slot until the appropriate configuration is found and then the post may be slid off to the side into the grove to secure the legs together. As one skilled in the art would recognize, there are numerous ways for securing the legs and brackets together so as to provide an adjustable securing means.

Referring back to FIGS. 2A-B, the adjustable anchor point 220 may be capable of extending past varying depths of structural members (or other support means). The adjustable anchor point 220 may be capable of anchoring posts for guard rail systems or other systems. According to one embodiment, the adjustable anchor point 220 may be part of or connected to the first (top) bracket 300 of the adjustable securing means 210.

Figure 5A:
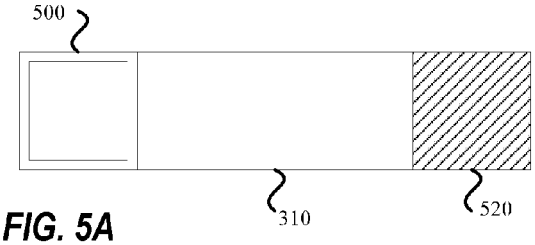
FIGS. 5A-C illustrate several example adjustable anchor points, according to one embodiment.

FIG. 5A illustrates an example adjustable anchor point that is configured into the first leg 310 of the first bracket 300. The end of the first leg 310 includes a receiving receptacle 500 having first and second distal ends, where both the first and second distal ends are opened. The receiving receptacle 500 acts as an anchor point and support (stanchion) that can be utilized to receive and anchor posts that may be part of a railing system or other systems. The receiving receptacle 500 needs to be located past a second edge (exterior) of the structural member in order to receive a post. As illustrated the receiving receptacle 500 is square shaped but it is not intended to be limited thereto. The receiving receptacle 500 may be connected to (e.g., welded) the leg 310. In order to adjust where the receiving receptacle 500 is located (e.g., ensure it located past the second edge of structural member and is located close enough to the second edge to meet specifications) one or more extension pieces 520 may or may not be utilized. The extension piece(s) 520 may be placed between the leg 320 and the leg 360 of the second bracket 340. The extension piece(s) 520 may have holes (not illustrated) lined up with the holes 330 in the leg 320. If the extension piece(s) 520 are utilized, the connection means 380 may pass through the leg 360, the extension piece(s) 520, and the leg 320. The extension piece(s) 520 may be plates that are similar, or the same, size and shape as the leg 320, may be frames having a similar, or the same, perimeter as the leg 320, may be tubes that align with the holes in the legs, some alternative, or some combination thereof.

Figure 5B:
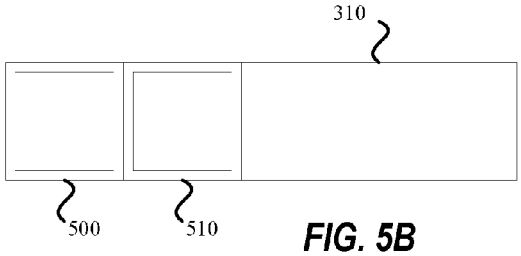

FIG. 5B illustrates an example adjustable anchor point that is configured into the first leg 310 of the first bracket 300. The end of the first leg 310 includes a plurality of receiving stanchions (two illustrated 500, 510) that can be utilized to receive and anchor items thereto. The receiving stanchions 500, 510 may be connected to (e.g., welded) the leg 310. The use of multiple receiving stanchions 500, 510 provide the adjustable nature of the anchor point. Depending on the depth of the structural member one or the other receiving receptacles 500, 510 may be used to anchor, for example, a post for a guard rail system. If a first one of the receiving receptacles 500, 510 is used to secure, for example, a post and the configuration supports it then a second one of the receiving receptacles 510, 500 could be utilized to anchor something else (e.g., signage, tool rack, hoist, downward post).

Figure 5C:
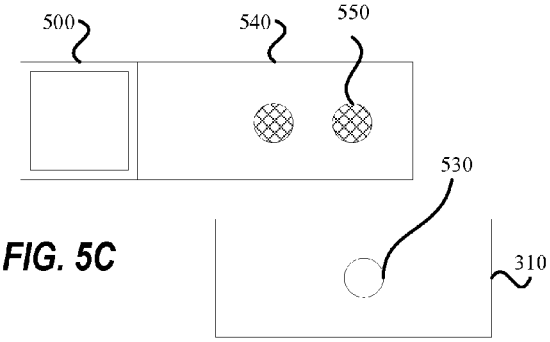

FIG. 5C illustrates an example adjustable anchor point that is configured to be connected to the first leg 310 of the first bracket 300. The adjustable anchor point includes a receiving receptacle 500 connected to a plate 540. The plate 540 may have dimensions similar to the leg 310. The plate 540 may include one or more posts 550 extending upward therefrom (two illustrated). The leg 310 may include one or more holes 530 formed therein (one illustrated). The plate 540 may rest on the upper surface of the structural member and the leg 310 may rest thereupon. In such an arrangement the leg 310 helps secure the plate 540 (especially when the receiving receptacle 500 has received something to anchor). The anchor point may be adjusted by selecting which post 550 extends through the hole 530. It should be noted that the number of posts 550 and holes 530 is not limited to the amount illustrated. The posts 550 may be threaded so that a bolt can be utilized to further secure the plate 540 and the leg 310.

It should be noted that the adjustable anchor point is not limited to the embodiments illustrated in FIGS. 5A-C. As one skilled in the art would recognize there are numerous ways to provide an anchor point that can be adjusted without departing from the current scope. For example, an anchor device may slide within or over a leg and the two devices may be secured at the appropriate location. The anchor device and the leg may have alignable holes that receive a securing means (e.g., bolt, pin, rod, screw) to secure them together when in the desired configuration (anchor point at appropriate location).

Figure 6:
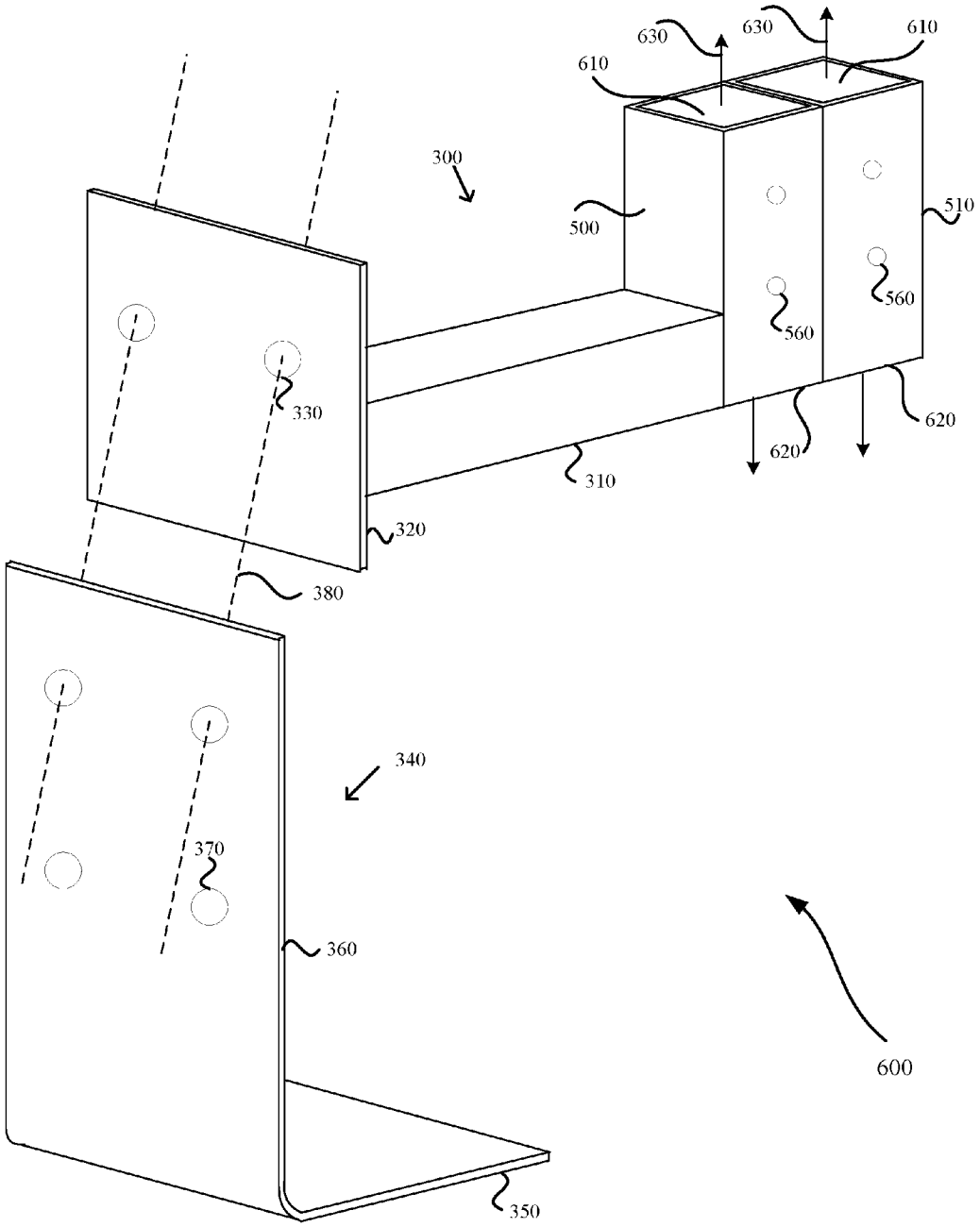
FIG. 6 illustrates a perspective view of an example mounting bracket that provides an adjustable securing means and an adjustable anchor point, according to one embodiment.

FIG. 6 illustrates a perspective view of an example mounting bracket 600 that provides an adjustable securing means and an adjustable anchor point. The mounting bracket 600 may be a component of a portable, re-useable fall protection system. The mounting bracket 600 may be secured to structural members (e.g., wall plate). The mounting bracket 600 is designed to be easily installed and be adjustable for varying configurations of supported weight and force (e.g. height of structural members, depth of bearing wall, height of floor cavity). The heights, thicknesses, shapes, widths, lengths, capacities and strengths of all the brackets and other components described herein may vary depending on the specific application.

The mounting bracket 600 may include a first bracket 300 and a second bracket 340. The first bracket 300 may include a first leg 310 (illustrated as horizontal) and a second leg 320 (illustrated as vertical). The first leg 310 may rest on a first surface (e.g., upper) of the structural member and the second leg 320 may extend away from the structural member (e.g., upward) in alignment with a first edge (e.g., interior) of the structural member. The second leg 320 may include one or more holes 330 formed therein (two illustrated). The holes 330 may be to receive a connection means (not illustrated) in order to secure the first bracket 300 to the second bracket 340 in an appropriate configuration based on size of the structural member. One or more stanchions (two illustrated) 500, 510 may be secured to the end of the first leg 310. The receiving receptacles 500, 510 are illustrated as being square but are not limited thereto. Each of the receiving receptacles 500, 510 include a first open distal end (e.g., top) 610 and a second open distal end (e.g., bottom) 620 and a pathway 630 therethrough (illustrated as a double sided arrow traversing the receptacles 500,510) so that they may be capable of receiving posts (e.g., square posts). The posts may be used as part of a railing systems or as part of other systems, including but not limited to, signage, tools, hoists and platforms.

The receiving receptacles 500, 510 may include holes 520 formed therethrough that are alignable with holes in posts that it may receive. The posts may be secured at the appropriate configuration by passing a connection means (e.g., screws, pins, rods) through the aligned holes 520. The receiving receptacle 500, 510 utilized to secure a post for a railing system depends on the specifics of the job being performed (e.g., depth of the structural member). The post needs to be past where work is to be performed but within the limits defined in the appropriate specifications (e.g., 2 inches). The configuration of the post and the receiving receptacle 500, 510 also varies based on providing the toe kick and railing at the appropriate heights.

The first leg 310 may have a similar size and shape to the receiving receptacles 500, 510 to assist in securing them together. The receiving receptacles 500, 510 may be welded together and may also be welded to the first leg 310. The first leg 310 may be welded to the second leg 320.

The second bracket 340 may be an L-shaped bracket that includes a first leg 350 (illustrated as horizontal) and a second leg 360 (illustrated as vertical). The first leg 350 may be in contact with a second surface (e.g., lower) of the structural member and the second leg 360 may extend toward the structural member (e.g., upward) with a portion of it resting on the first edge (e.g., interior) of the structural member. The second leg 360 may include one or more holes 370 (four illustrated, 2 columns of two) formed therein. The holes 370 may be to receive a connection means 380 (e.g., a bolt, a rod, a screw) in order to secure the first bracket 300 to the second bracket 340 in an appropriate configuration based on size of the structural member.

Figure 7A:
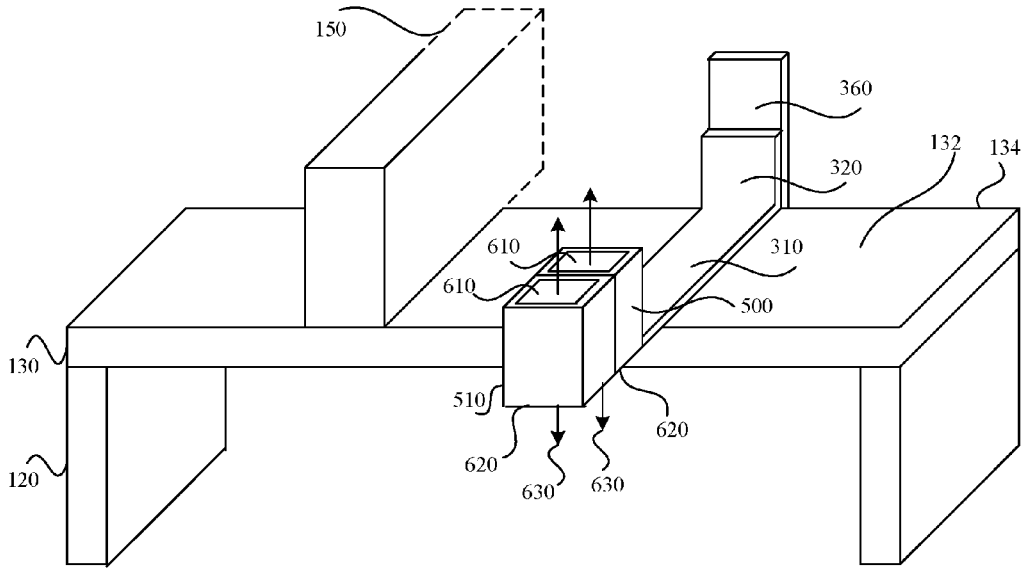
FIGS. 7A-7B illustrate exterior and interior perspective views respectively of an example mounting bracket secured to a structural member, according to one embodiment.
Figure 7B:
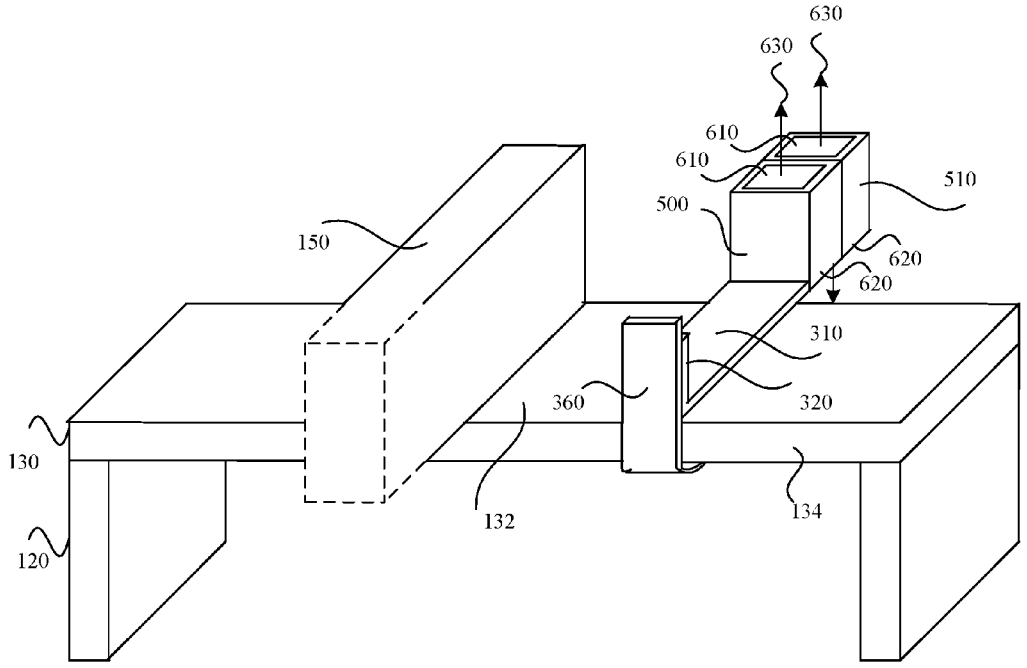
Figure 7C:
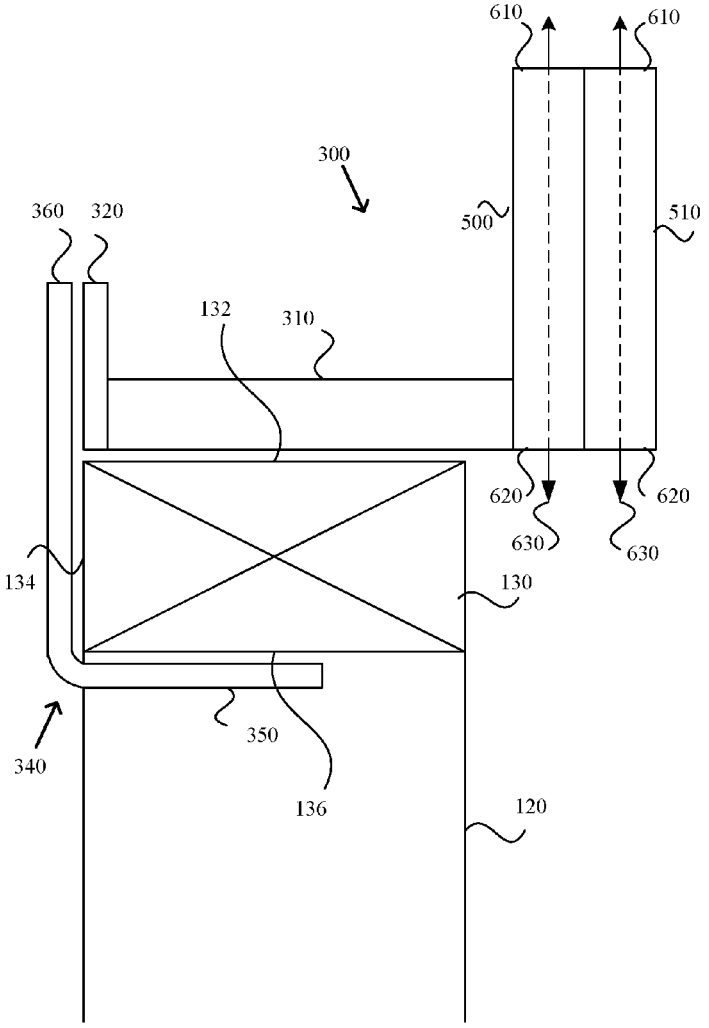
FIG. 7C illustrates a side view of an example mounting bracket secured to a structural member, according to one embodiment.

FIGS. 7A-7B illustrate exterior and interior perspective views respectively of an example mounting bracket (e.g., 600 of FIG. 6) secured to a structural member 130. The framing members 120 and joists 150 are also illustrated to provide perspective. FIG. 7C illustrates a side view of an example mounting bracket (e.g., 600 of FIG. 6) secured to a structural member 130.

Figure 8:
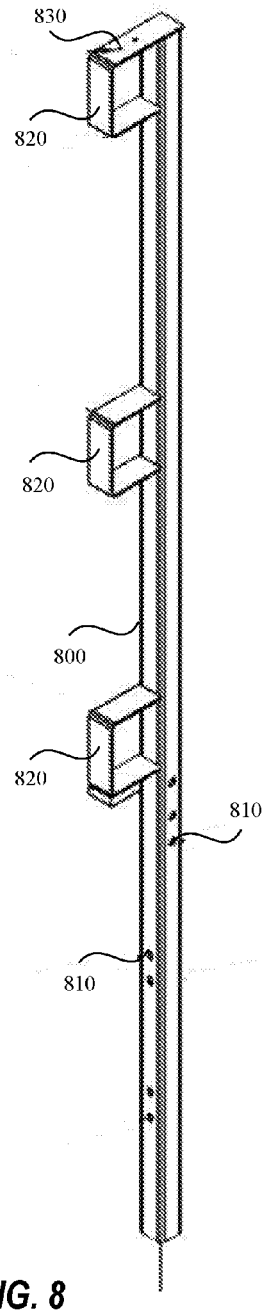
FIG. 8 illustrates a perspective view of an example post that may be used as part of a portable, re-useable fall protection system, according to one embodiment.

FIG. 8 illustrates a perspective view of an example post 800 that may be used as part of a portable, re-useable fall protection system. The post 800 is illustrated as being square shaped just like the brackets 500, 510 but is not limited thereto. The post 800 may be slightly smaller than the receiving receptacles 500, 510 so as to be received thereby. The post 800 may include a plurality of holes 810 formed therein that are alignable with the holes 520 in the receiving receptacles 500, 510. The configuration of the post 800 within a receiving receptacle 500, 510 may be selected based on, for example, different floor cavity heights. At the appropriate configuration, the post 800 may be secured within the receiving receptacle 500, 510 using a securing means (e.g., pins, bolts, rods).

The post 800 may include a plurality of brackets 820 (e.g., three illustrated) connected thereto. The brackets 820 may extend from the post in a direction oriented toward the bearing wall. The brackets 820 may be welded or otherwise permanently attached to the post 800. The brackets 820 may be, for example, "L" shaped where the top end is open to receive a rail or may be "U" shaped (as illustrated) where the brackets 820 are enclosed and the rail needs to be slid thereinto from the side. The rails may be made of wood, aluminum or other materials providing sufficient strength and durability. The rails may be, for example, conventional 2"×4" or 2"×8" railings, but the size is not limited thereto. The brackets 820 may include hole(s) 830 formed therein enabling a securing means (e.g., screw, nail) to secure the rail therein.

Figure 9:
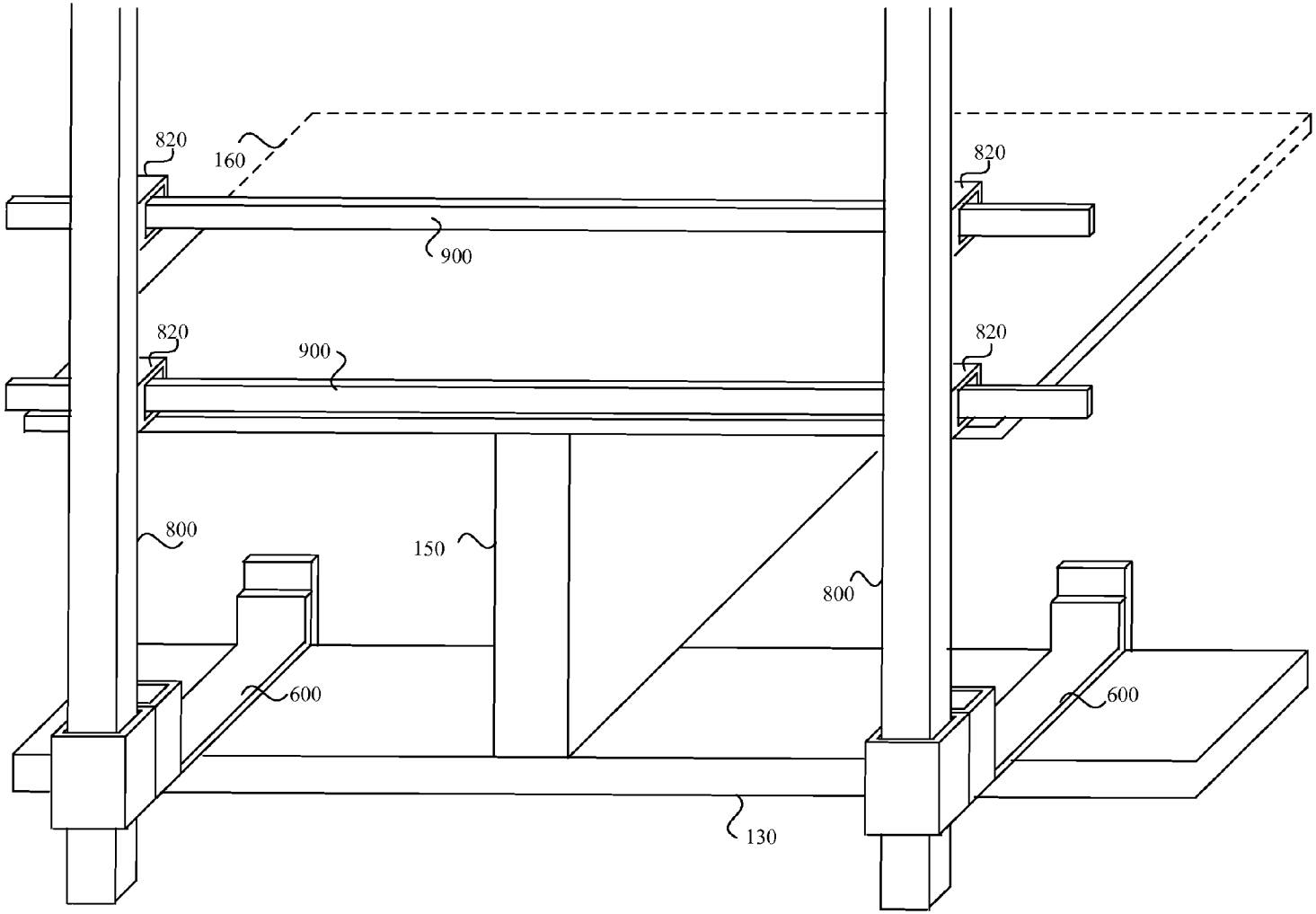
FIG. 9 illustrates an example portable, re-useable fall protection system in use, according to one embodiment.

FIG. 9 illustrates an example portable, re-useable fall protection system in use. The portable, re-useable fall protection system is utilized to provide a railing system for a next level that does not require an individual to go the next level to install. The system includes mounting brackets 600, posts 800, and rails 900. The mounting brackets 600 are secured to a structural member 130 of a lower level. The anchor point extends past the second edge (e.g., exterior) of the structural member 130 so that the posts 800 can be received therein and not interfere with work being performed on the next level. The configuration of the posts 800 within the mounting brackets 600 is based on, for example, the height of a joist 150. The post 800 should be configured such that one of the brackets 820 (e.g., lowest) is aligned such that when a rail 900 is placed therein it acts as a kick plate for a floor 160 of the next level.

The posts have been illustrated and discussed with respect to railing systems but are not intended to be limited thereto. Rather, the posts could include varies items (e.g., connectors, hooks, platforms) connected thereto that enable the posts to be part of any number of systems. For example, the posts could include various hooks that enable a worker to secure their tools or the like thereto. The posts may include connectors that enable signs to be hung therefrom. The posts may include platforms that enable walkways to be formed between posts. As one skilled in the art would recognize, the mounting brackets 600 enables posts having different configurations to be connected thereto and thus enables various different systems to be created.

According to one embodiment, an anchor point may be desired past the first edge (e.g., internally) of the structural member as well as past the second edge (e.g., externally). The anchor point may be utilized to secure, for example, a frame for a walkway that could be utilized to perform operations on the lower level. The anchor point may be included on a second bracket of the mounting bracket. The anchor point may include a receiving receptacle connected to the second bracket.

Figure 10:
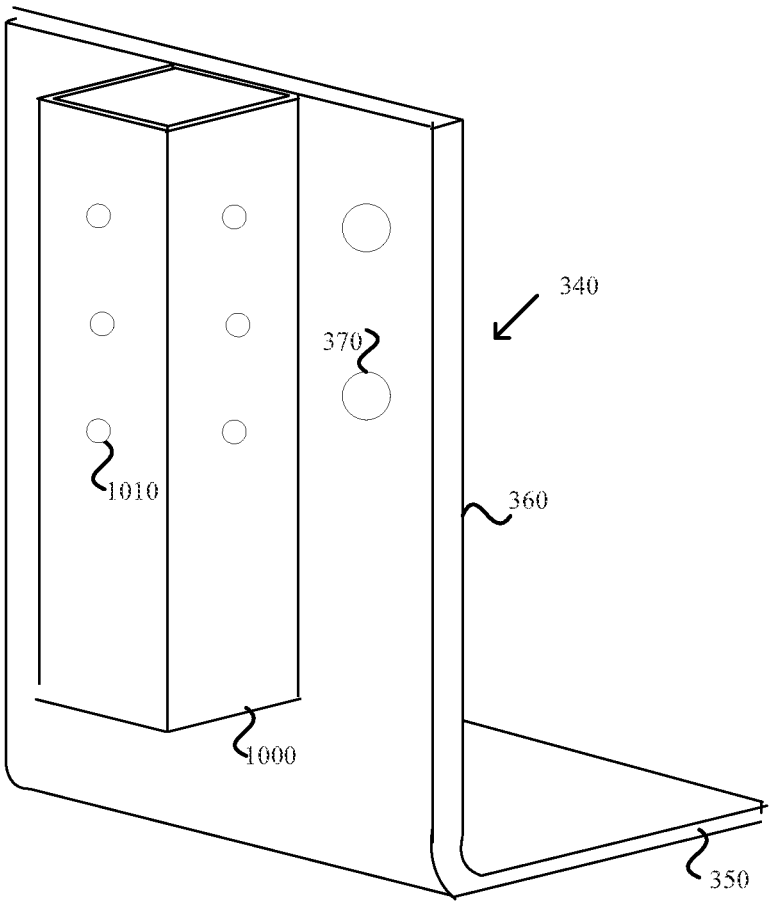
FIG. 10 illustrates a perspective view of a second bracket providing an anchor point according to one embodiment.

FIG. 10 illustrates a perspective view of a second bracket 340 providing an anchor point. The second leg 360 may have a receiving receptacle 1000 secured thereto. The receiving receptacle 1000 may have holes 1010 formed therein to enable a post or the like to be secured therein. The receiving receptacle 1000 may be welded to the second leg 360.

Figure 11:
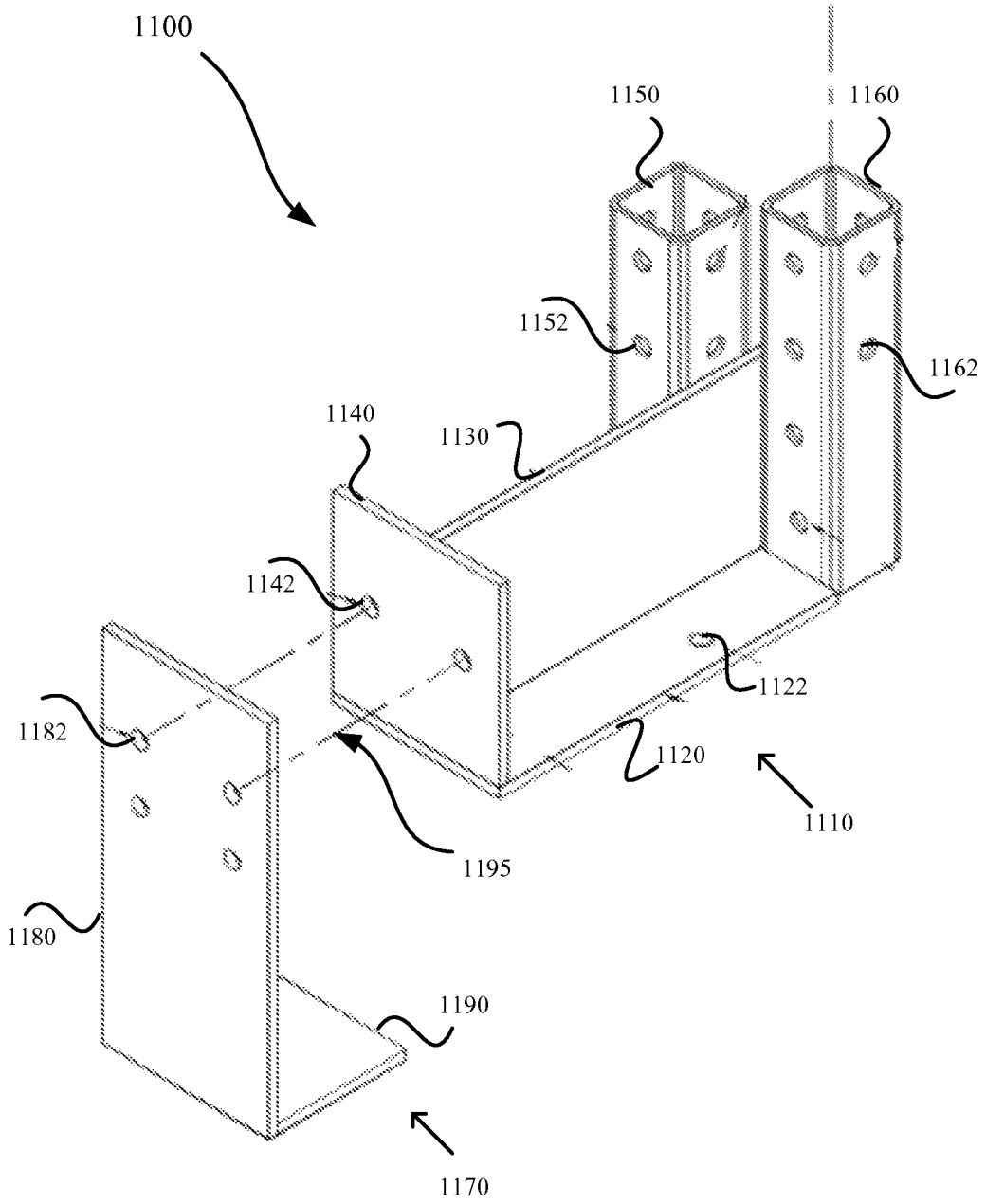
FIG. 11 illustrates a perspective view of an example mounting bracket that provides an adjustable securing means and an adjustable anchor point, according to one embodiment.

FIG. 11 illustrates a perspective view of an example mounting bracket 1100 that provides an adjustable securing means and an adjustable anchor point. The mounting bracket 1100 may include a first (e.g., top) bracket 1110, a second (e.g., bottom) bracket 1170, and a connection means 1195 (simply illustrated as dashed lines between the first bracket 1110 and the second bracket 1170) to secure the first bracket 1110 and the second bracket 1170 together.

The first bracket 1110 may include a plurality of plates (e.g., three illustrated) 1120, 113, 1140 and one or more (e.g., two illustrated) open-ended receiving stanchions 1150, 1160. The plates 1120, 113, 1140 and the receiving receptacles 1150, 1160 may be made of galvanized light gauge steel, formed metal, composite or other materials providing sufficient strength and durability. The second plate 1130 may be connected perpendicularly to the first plate 1120 (illustrated as being located at center line of the first plate 1120 but not limited thereto). The first and second plates 1120, 1130 may be welded or otherwise permanently attached. As illustrated, the first plate 1120 runs horizontally and may act as a base (first leg) and the second plate 1130 runs vertically and may act as a spine. The first and second plates 1120, 1130 may be aligned at a first end and the second plate 1130 may extend past the first plate 1120 at a second end. The first plate 1120 may include hole(s) 1122 formed therein on either side, or both sides, of the second plate (spine) 1130. The hole(s) 1122 may optionally receive a securing means (e.g., nail, screw, bolt, fastener) to anchor the top bracket 1110 to a structural member.

The third plate 1140 may be connected perpendicularly to the first end of the first and second plates 1120, 1130 (illustrated as lower edge connecting to first plate 1120 and center vertically connecting to second plate 1130). The plates 1120, 1130, 1140 may be welded or otherwise permanently attached to each other. The third plate 1140 may have dimensions equal to respective sides (e.g., short sides) of the first and second plates 1120, 1130 (illustrated as a square). The third plate 1140 (second leg) may include hole(s) 1142 formed therein on either side, or both sides, of the second plate (spine) 1130 (e.g., one hole illustrated on each side of the spine 1130). The hole(s) 1142 may receive a securing means (e.g., nail, screw, bolt, fastener) the purpose of which will be described in more detail later. According to one embodiment, the first plate 1120 and the third plate 1140 may be a single plate that is bent to create an angle (e.g., 90 degrees as illustrated).

The receiving receptacles 1150, 1160 are illustrated as being square, but are not limited thereto. The receiving receptacles 1150, 1160 may enable a post to pass therethrough and be secured therein. The receiving receptacles 1150, 1160 are located at the second end of the first and second plates 1120, 1130. The receiving receptacles 1150, 1160 are secured to the second plate 1130 at a location past the end of the first plate 1120 so the first plate 1120 does not interfere with a post passing therethrough. The receiving receptacles 1150, 1160 (e.g., lower edge as illustrated) may be secured to an edge of the second side of the first plate 1120 and extend upward therefrom.

As illustrated, a first receiving receptacle 1150 is mounted on a first side (far side as illustrated) of the second plate 1130 (spine) and a second receiving receptacle 1160 is mounted on a second side (close side as illustrated) of the second plate 1130. The second receiving receptacle 1160 may be mounted at the second end of the second plate 1130 (act as a rear/outer receiving receptacle) and the first receiving receptacle 1150 may be mounted a certain distance from the second end of the second plate 1130 (act as a forward/inner receiving receptacle). The second end of the first plate 1120 may be stepped so that a respective one of the receiving receptacles 1150, 1160 can be secured to a respective edge of the first plate 1120. For example, as illustrated a second side (close side) of first plate 1120 may extend further than a first side (far side) so as to connect to the second (rear/outer) receiving receptacle 1160 and the first (forward/inner) receiving receptacle 1150 respectively.

The receiving receptacles 1150, 1160 may include holes 1152, 1162 formed therein for the purpose of receiving a securing means (e.g., pins, bolts, rods) to secure a post (e.g., a post having one or more sets of aligned holes) therein at a defined height.

The second bracket 1170 may include two plates 1180, 1190. The fourth and fifth plates 1180, 1190 may be made of galvanized light gauge steel, formed metal, composite or other materials providing sufficient strength and durability. The fourth and the fifth plates 1180, 1190 (second and first legs of the second bracket 1170) may have the same width and may be perpendicularly connected to each at edges thereof so as to form an "L". The plates 1180, 1190 may be welded or otherwise permanently attached to each other. The fourth plate 1180 may include a plurality of holes 1182 capable of being aligned with the hole(s) 1142 (2 rows of 2 holes illustrated). According to one embodiment, the fourth and fifth plates 1180, 1190 may be a single plate that is bent to create an angle (e.g., 90 degrees as illustrated).

The first bracket 1110 and the second bracket 1170 may be secured to one another in a non-permanent and adjustable manner such that the third plate 1140 and the fourth plate 1180 abut each other. The plates 1140, 1180 may be secured to each other by aligning the hole(s) 1142 with select hole(s) of the plurality of alignable holes 1182 and securing together with the connection means 1195. The connection means 1195 may be, for example, bolts, screws, or pins and nuts may also be utilized for additional securing. The plurality of alignable holes 1182 enables adjustment in the configuration of how the plates 1140, 1180 and the first bracket 1110 and the second bracket 1170 are secured together. The adjustment is to provide the ability to utilize the mounting bracket 1100 with, for example, different depths of structural members.

The mounting bracket 1100 may be installed such that the first plate 1120 of the first bracket 1110 is placed on a first (e.g., upper) surface of the structural member and the third plate extends away from (upward) the structural member in alignment with a first edge (e.g., interior) thereof. The receiving receptacles 1150, 1160 may extend past a second (e.g., exterior) edge of the structural member such that one of the receiving receptacles 1150, 1160 can be used to secure posts of a railing system. The fifth plate 1190 of the second bracket 1170 may be placed against a second (e.g., lower) surface of the structural member and the fourth plate 1180 may extend toward (upward) the structural member such that it rests on the first (interior) edge thereof. The second bracket 1170 and the first bracket 1110 are secured by aligning the hole(s) 1142 with select hole(s) of the plurality of alignable holes 1182 to account for depth of the structural member and securing together with the securing means 1195.

Although the invention has been illustrated by reference to specific embodiments, it will be apparent that the invention is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A mounting bracket to be utilized in a fall protection system, the mounting bracket comprising:

an adjustable securing means to anchor to a structural member, wherein the adjustable securing means includes a first bracket having a first leg to contact a top of the structural member and a second leg to extend up from the top of the structural member in alignment with a first side of the structural member; and a second bracket having a first leg to contact a bottom of the structural member and a second leg to extend up from the bottom of the structural member and to be in contact with the first side of the structural member and the second leg of the first bracket, and wherein the adjustable securing means is configured to enable a distance between the first leg of the first bracket and the first leg of the second bracket to be adjusted so as to enable the adjustable securing means to be utilized with structural members of different heights; and a plurality of receiving receptacles mounted to an end of the first leg of the first bracket of the adjustable securing means, wherein the end of the first leg of the first bracket is configured to be located away from the first side of the structural member, wherein the plurality of receiving receptacles is substantially perpendicular to, and extends upward from, the first leg of the first bracket and is configured to extend upward from the top of the structural member, wherein the plurality of receiving receptacles includes, at least, a first receiving receptacle and a second receiving receptacle, wherein the first receiving receptacle and the second receiving receptacle are mounted in alignment with each other and are both mounted in alignment with the first bracket, wherein the first receiving receptacle is adjacent to the end of the first leg of the first bracket and is directly connected to the end of the first leg of the first bracket, wherein the second receiving receptacle is adjacent to the first receiving receptacle and is directly connected to the first receiving receptacle, wherein each of the plurality of receiving receptacles is configured to be located at a different distance from the first side of the structural member and at least one of the plurality of receiving receptacles is configured to extend past a second side of the structural member, wherein each of the plurality of receiving receptacles includes a pathway running therethrough from a first open distal end to a second open distal end opposite the first open distal end, wherein the pathway of each of the plurality of receiving receptacles is substantially perpendicular to the first leg of the first bracket and is substantially parallel to each other, wherein the first open distal end and the second open distal end of each of the plurality of receiving receptacles are accessible when the plurality of receiving receptacles is mounted to the end of the first leg of the first bracket so as to allow a post to be received from the first open distal end of one of the plurality of receiving receptacles and to extend through the pathway and out of the second open distal end thereof or to allow the post to be received from the second open distal end of the one of the plurality of receiving receptacles and to extend through the pathway and out of the first open distal end thereof, and wherein a receiving receptacle from the plurality of receiving receptacles is to be selected based on a depth of the structural member so as to allow the post received therein to extend past the second side of the structural member and to be within a distance from the second side of the structural member.

2. The mounting bracket of claim 1, wherein each of the plurality of receiving receptacles is to act as an anchor point and a support for the post.

3. The mounting bracket of claim 1, wherein the plurality of receiving receptacles is capable of securing the post extending up or extending down therefrom.

4. The mounting bracket of claim 1, wherein the plurality of receiving receptacles is capable of securing the post in different configurations based on use of the post.

5. The mounting bracket of claim 1, wherein each of the plurality of receiving receptacles includes at least one hole traversing through sides thereof to receive a connecting member therewithin to secure the post.

6. The mounting bracket of claim 5, wherein the adjustable securing means further includes a connector to secure the second leg of the first bracket and the second leg of the second bracket together in order to anchor the adjustable securing means to the structural member, wherein the second leg of the first bracket and the second leg of the second bracket are configured to be secured to each other in different configurations so as to be able to adjust the distance between the first leg of the first bracket and the first leg of the second bracket.

7. The mounting bracket of claim 6, wherein the second leg of the first bracket includes a plurality of holes formed therein;

the second leg of the second bracket includes a plurality of holes formed therein; and the connector includes a plurality of bolts, wherein the different configurations are achieved by placing the plurality of bolts through different combinations of the plurality of holes formed in the second leg of the first bracket and the plurality of holes formed in the second leg of the second bracket.

8. The mounting bracket of claim 6, wherein the connector is to secure the second leg of the first bracket and the second leg of the second bracket together on the first side of the structural member above the structural member.

9. A mounting bracket to be utilized in a fall protection system, the mounting bracket comprising:

an adjustable securing means to anchor to a structural member, wherein the adjustable securing means includes a first bracket having a first leg that is to rest on a top of the structural member and a second leg that is to extend up from the structural member in alignment with a first side of the structural member, a second bracket having a first leg that is to be in contact with a bottom of the structural member and a second leg that is to extend up from the bottom of the structural member and is to be in contact with the first side of the structural member and the second leg of the first bracket, and a connector to secure the second leg of the first bracket and the second leg of the second bracket together, wherein the second leg of the first bracket and the second leg of the second bracket are configured to be connected to each other in different configurations so as to be able to adjust a distance between the first leg of the first bracket and the first leg of the second bracket, and wherein a connection configuration of the second leg of the first bracket and the second leg of the second bracket is to be selected based on a height of the structural member; and a plurality of receiving receptacles mounted to an end of the first leg of the first bracket, wherein the end of the first leg of the first bracket is opposite to the second leg of the first bracket, wherein the plurality of receiving receptacles is substantially perpendicular to, and extends upward from, the first leg of the first bracket and is configured to extend upward from the top of the structural member, wherein the plurality of receiving receptacles includes, at least, a first receiving receptacle and a second receiving receptacle, wherein the first receiving receptacle and the second receiving receptacle are mounted in alignment with each other and are both mounted in alignment with the first leg of the first bracket, wherein the first receiving receptacle is mounted adjacent to the end of the first leg of the first bracket and is directly connected to the end of the first leg of the first bracket, wherein the second receiving receptacle is mounted adjacent to the first receiving receptacle and is directly connected to the first receiving receptacle, wherein each of the plurality of receiving receptacles is configured to be located at a different distance from the second leg of the first bracket and at least one of the plurality of receiving receptacles is configured to extend past a second side of the structural member, wherein each of the plurality of receiving receptacles includes a pathway running therethrough from a first open distal end to a second open distal end opposite the first open distal end, wherein the pathway of each of the plurality of receiving receptacles is substantially perpendicular to the first leg of the first bracket and is substantially parallel to each other, wherein the first open distal end and the second open distal end of each of the plurality of receiving receptacles are accessible when the plurality of receiving receptacles is mounted to the end of the first leg of the first bracket so as to allow a post to be received from the first open distal end of one of the plurality of receiving receptacles and to extend through the pathway and out of the second open distal end thereof or to allow the post to be received from the second open distal end of the one of the plurality of receiving receptacles and to extend through the pathway and out of the first open distal end thereof, and wherein a receiving receptacle of the plurality of receiving receptacles is to be selected based on a depth of the structural member so as to allow the post secured therein to extend past the second side of the structural member and to be within a distance from the second side of the structural member.

10. The mounting bracket of claim 9, wherein each of the plurality of receiving receptacles is to act as an anchor point and a support for the post.

11. The mounting bracket of claim 9, wherein the second leg of the first bracket includes a plurality of holes formed therein;

the second leg of the second bracket includes a plurality of holes formed therein; and the connector includes a plurality of bolts, wherein the different configurations are achieved by placing the plurality of bolts through different combinations of the plurality of holes formed in the second leg of the first bracket and the plurality of holes formed in the second leg of the second bracket.

12. The mounting bracket of claim 9, wherein the plurality of receiving receptacles is capable of securing the post in different configurations based on use of the post.

13. The mounting bracket of claim 9, wherein the connector is to secure the second leg of the first bracket and the second leg of the second bracket together on the first side of the structural member above the structural member.

14. The mounting bracket of claim 9, wherein the plurality of receiving receptacles is capable of securing the post extending up or extending down therefrom.

15. A mounting bracket to be utilized in a fall protection system, the mounting bracket comprising:

a first bracket having a first leg to rest on a top of a structural member and a second leg, substantially perpendicular to the first leg, to extend up from the top of the structural member in substantial alignment with a first side of the structural member, a second bracket having a first leg to be in contact with a bottom of the structural member and a second leg, substantially perpendicular to the first leg, to extend up from the bottom of the structural member and to be in contact with the first side of the structural member and the second leg of the first bracket, a connector to secure the second leg of the first bracket and the second leg of the second bracket together above the structural member, wherein the second leg of the first bracket and the second leg of the second bracket are configured to be connected to each other in different configurations so as to be able to adjust a distance between the first leg of the first bracket and the first leg of the second bracket, and wherein a connection configuration of the second leg of the first bracket and the second leg of the second bracket is to be selected based on a height of the structural member; and a plurality of receiving receptacles mounted to an end of the first leg of the first bracket, wherein the end of the first leg of the first bracket is opposite to the second leg of the first bracket, wherein the plurality of receiving receptacles is substantially perpendicular to, and extends upward from, the first leg of the first bracket and is configured to extend upward from the top of the structural member, wherein the plurality of receiving receptacles includes, at least, a first receiving receptacle and a second receiving receptacle, wherein the first receiving receptacle and the second receiving receptacle are mounted in alignment with each other and are both mounted in alignment with the first leg of the first bracket, wherein the first receiving receptacle is mounted adjacent to the end of the first leg of the first bracket and is directly connected to the end of the first leg of the first bracket, wherein the second receiving receptacle is mounted adjacent to the first receiving receptacle and is directly connected to the first receiving receptacle, wherein each of the plurality of receiving receptacles is configured to be located at a different distance from the second leg of the first bracket and at least one of the plurality of receiving receptacles is configured to extend past a second side of the structural member, wherein each of the plurality of receiving receptacles includes a pathway running therethrough from a first open distal end to a second open distal end opposite the first open distal end, wherein the pathway of each of the plurality of receiving receptacles is substantially perpendicular to the first leg of the first bracket and is substantially parallel to each other, wherein the first open distal end and the second open distal end of each of the plurality of receiving receptacles are accessible when the plurality of receiving receptacles is mounted to the end of the first leg of the first bracket so as to allow a post to be received from the first open distal end of one of the plurality of receiving receptacles and to extend through the pathway and out of the second open distal end thereof or to allow the post to be received from the second open distal end of the one of the plurality of receiving receptacles and to extend through the pathway and out of the first open distal end thereof, and wherein a receiving receptacle from the plurality of receiving receptacles is to be selected based on a depth of the structural member so as to allow the post received therein to extend past the second side of the structural member and to be within a distance from the second side of the structural member.

16. The mounting bracket of claim 15, wherein each of the plurality of receiving receptacles is to act as an anchor point and a support for the post.

17. The mounting bracket of claim 15, wherein the plurality of receiving receptacles is capable of securing the post extending up or extending down therefrom.

18. The mounting bracket of claim 15, wherein the plurality of receiving receptacles is capable of securing the post in different configurations based on use of the post.

19. The mounting bracket of claim 15, wherein the second leg of the first bracket includes a plurality of holes formed therein;

the second leg of the second bracket includes a plurality of holes formed therein; and the connector includes a plurality of bolts, wherein the different configurations are achieved by placing the plurality of bolts through different combinations of the plurality of holes formed in the second leg of the first bracket and the plurality of holes formed in the second leg of the second bracket.

* * * * *